US010378300B2

(12) United States Patent
Nguyen et al.

(10) Patent No.: US 10,378,300 B2
(45) Date of Patent: Aug. 13, 2019

(54) SYSTEM AND METHOD FOR LANDING EQUIPMENT WITH RETRACTABLE SHOULDER ASSEMBLY

(71) Applicant: Cameron International Corporation, Houston, TX (US)

(72) Inventors: Dennis P. Nguyen, Pearland, TX (US); KyThu Do Nguyen, Friendswood, TX (US); Jordan Alan Whiteman, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 15/289,952

(22) Filed: Oct. 10, 2016

(65) Prior Publication Data

US 2018/0100368 A1 Apr. 12, 2018

(51) Int. Cl.

| | |
|---|---|
| ***E21B 33/03*** | (2006.01) |
| ***E21B 33/04*** | (2006.01) |
| ***E21B 23/02*** | (2006.01) |

(52) U.S. Cl.

CPC ..... *E21B 33/03* (2013.01); *E21B 23/02* (2013.01); *E21B 33/04* (2013.01)

(58) Field of Classification Search

CPC ..... E21B 33/03; E21B 33/04

See application file for complete search history.

(56) References Cited

U.S. PATENT DOCUMENTS

| | | | | |
|---|---|---|---|---|
| 3,807,497 | A * | 4/1974 | Baugh | E21B 33/047 166/87.1 |
| 3,937,279 | A | 2/1976 | Raulins | |
| 5,456,321 | A * | 10/1995 | Shiach | E21B 33/04 166/382 |
| 6,598,673 | B1 | 7/2003 | Hosie et al. | |
| 2006/0016604 | A1 | 1/2006 | Ford | |
| 2012/0000664 | A1* | 1/2012 | Nas | E21B 33/085 166/344 |
| 2016/0186520 | A1 | 6/2016 | Nguyen | |
| 2017/0101840 | A1* | 4/2017 | Kauffmann | E21B 33/0422 |

OTHER PUBLICATIONS

PCT Search Report and Written Opinion for PCT/US2017/055978, dated Dec. 6, 2017; 12 pgs.

* cited by examiner

*Primary Examiner* — Nicole Coy
*Assistant Examiner* — Dany E Akakpo
(74) *Attorney, Agent, or Firm* — Fletcher Yoder, P.C.

(57) ABSTRACT

A load shoulder assembly is provided to land a component in a bore of a mineral extraction system. The load shoulder assembly includes a housing and a retractable shoulder assembly disposed in the housing. The retractable shoulder assembly is configured to selectively move a load shoulder surface between a retracted position and an extended position relative to the bore.

17 Claims, 6 Drawing Sheets

SYSTEM AND METHOD FOR LANDING EQUIPMENT WITH RETRACTABLE SHOULDER ASSEMBLY

BACKGROUND

This section is intended to introduce the reader to aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Oil and natural gas have a profound effect on modern economies and societies. In order to meet the demand for such natural resources, numerous companies invest significant amounts of time and money in searching for, accessing, and extracting oil, natural gas, and other subterranean resources. Particularly, once a desired resource is discovered below the surface of the earth, drilling and production systems are often employed to access and extract the resource. These systems can be located onshore or offshore depending on the location of a desired resource. Such systems generally include a wellhead assembly through which the resource is extracted. These wellhead assemblies generally include a wide variety of components and/or conduits, such as blowout preventers (BOPs), as well as various control lines, casings, valves, and the like, that control drilling and/or extraction operations. Shoulders may be used to locate and support components within the wellhead assembly. Unfortunately, existing shoulders may create problems with full bore access.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
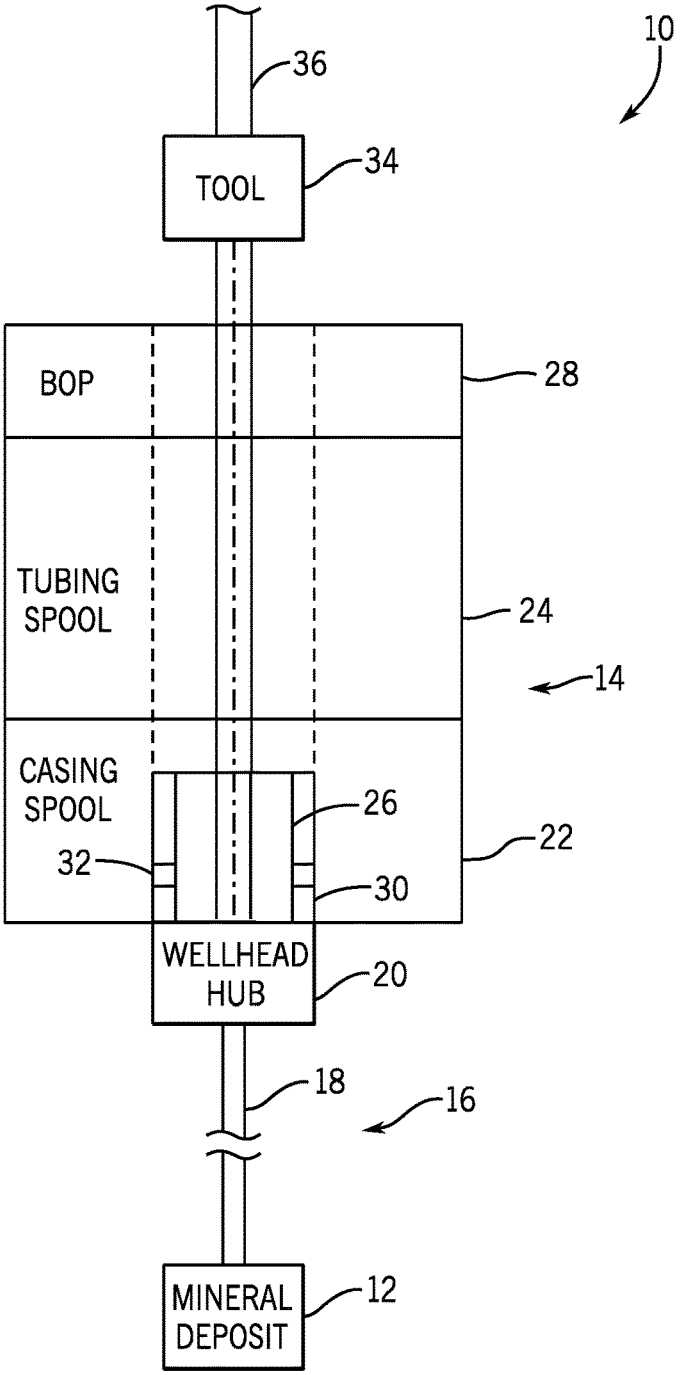
FIG. 1 is a schematic of an embodiment of a mineral extraction system.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

As discussed in detail below, the disclosed embodiments include a high strength load shoulder assembly with an internal retractable shoulder assembly disposed in a housing (e.g., multi-part housing), which is configured to land on and couple to a tubular (e.g., casing, tubing string, wellhead, or other mineral extraction component). The high strength load shoulder assembly is configured to land a component (e.g., hanger, valve, plug, wellhead component, or mineral extraction component) in a bore of a mineral extraction system. The internal retractable shoulder assembly is configured to selectively move a load shoulder surface (e.g., load bearing landing surface on a load member such as a load ring) between a retracted position (e.g., full bore position or configuration) and an extended position (e.g., active load shoulder position or configuration) relative to the bore. The full bore position does not protrude beyond an inner circumference of the bore, and thus provides full bore access to the bore. The active load shoulder position extends beyond the inner circumference of the bore, and thus enables landing of the component in the bore (i.e., landing on the load shoulder surface). In certain embodiments, an actuator (e.g., electric actuator, fluid-driven actuator, or mechanical actuator) is coupled to the retractable shoulder assembly, wherein the actuator is configured to drive movement of the load shoulder surface between the retracted position and the extended position. Furthermore, the internal retractable shoulder assembly may include a retainer and an energizing member, wherein the load member (e.g., load ring), the energizing member (e.g., push member or push ring), and the retainer (e.g., retainer ring) are disposed in an annular chamber inside the housing. The retainer is configured to retain the load member and the energizing member within the housing. The energizing member is driven to move (e.g., axially) by the actuator to drive the load member to move (e.g., radially) between the retracted and extended positions. In this manner, the high strength load shoulder assembly is configured to enable a controlled change between a full bore configuration and an active load shoulder configuration.

FIG. 1 is a schematic of an exemplary mineral extraction system 10 configured to extract various natural resources, including hydrocarbons (e.g., oil and/or natural gas), from a mineral deposit 12. Depending upon where the natural resource is located, the mineral extraction system 10 may be land-based (e.g., a surface system) or subsea (e.g., a subsea system). The illustrated system 10 includes a wellhead assembly 14 coupled to the mineral deposit 12 or reservoir via a well 16. Specifically, a well bore 18 extends from the reservoir 12 to a wellhead hub 20 located at or near the surface.

The illustrated wellhead hub 20, which may be a large diameter hub, acts as an early junction between the well 16 and the equipment located above the well. The wellhead hub 20 may include a complementary connector, such as a collet connector, to facilitate connections with the surface equipment. The wellhead hub 20 may be configured to support various strings of casing or tubing that extend into the wellbore 18, and in some cases extending down to the mineral deposit 12.

The wellhead 14 generally includes a series of devices and components that control and regulate activities and conditions associated with the well 16. For example, the wellhead 14 may provide for routing the flow of produced minerals from the mineral deposit 12 and the well bore 18, provide for regulating pressure in the well 16, and provide for the injection of chemicals into the well bore 18 (downhole). In the illustrated embodiment, the wellhead 14 includes a casing spool 22 (e.g., tubular), a tubing spool 24 (e.g., tubular), a hanger 26 (e.g., a tubing hanger or a casing hanger), and a blowout preventer (BOP) 28.

In operation, the wellhead 14 enables completion and workover procedures, such as tool insertion into the well 16 for installation and removal of various components (e.g., hangers, shoulders, etc.). Further, minerals extracted from the well 16 (e.g., oil and natural gas) may be regulated and routed via the wellhead 14. For example, the blowout preventer (BOP) 28 may include a variety of valves, fittings, and controls to prevent oil, gas, or other fluid from exiting the well 16 in the event of an unintentional release of pressure or an overpressure condition.

As illustrated, the casing spool 22 defines a bore 30 that enables fluid communication between the wellhead 14 and the well 16. Thus, the casing spool bore 30 may provide access to the well bore 18 for various completion and workover procedures, such as emplacing tools or components within the casing spool 22. To emplace the components, a shoulder 32 provides a temporary or permanent landing surface that can support and/or locate pieces of equipment in the wellhead assembly 14. For example, the illustrated embodiment of the extraction system 10 includes a tool 34 suspended from a drill string 36. In certain embodiments, the tool 34 may include running tools (e.g., hanger running tools, shoulder running tools, slip tools, etc.) that are lowered (e.g., run) to the well 16, the wellhead 14, and the like. The tool 34 may be used to install the shoulder 32, and then install the hanger 26 or some other component (e.g., plug, back pressure valve, check valve, wellhead component, or mineral extraction component) on the shoulder 32. In certain embodiments, a single tool 34 may be used to run and sequentially land both the shoulder 32 and the hanger 26 in a single trip. However, in other embodiments, the shoulder 32 may be run and installed in a first trip, followed by running and installing the hanger 26 in a second trip.

Figure 2:
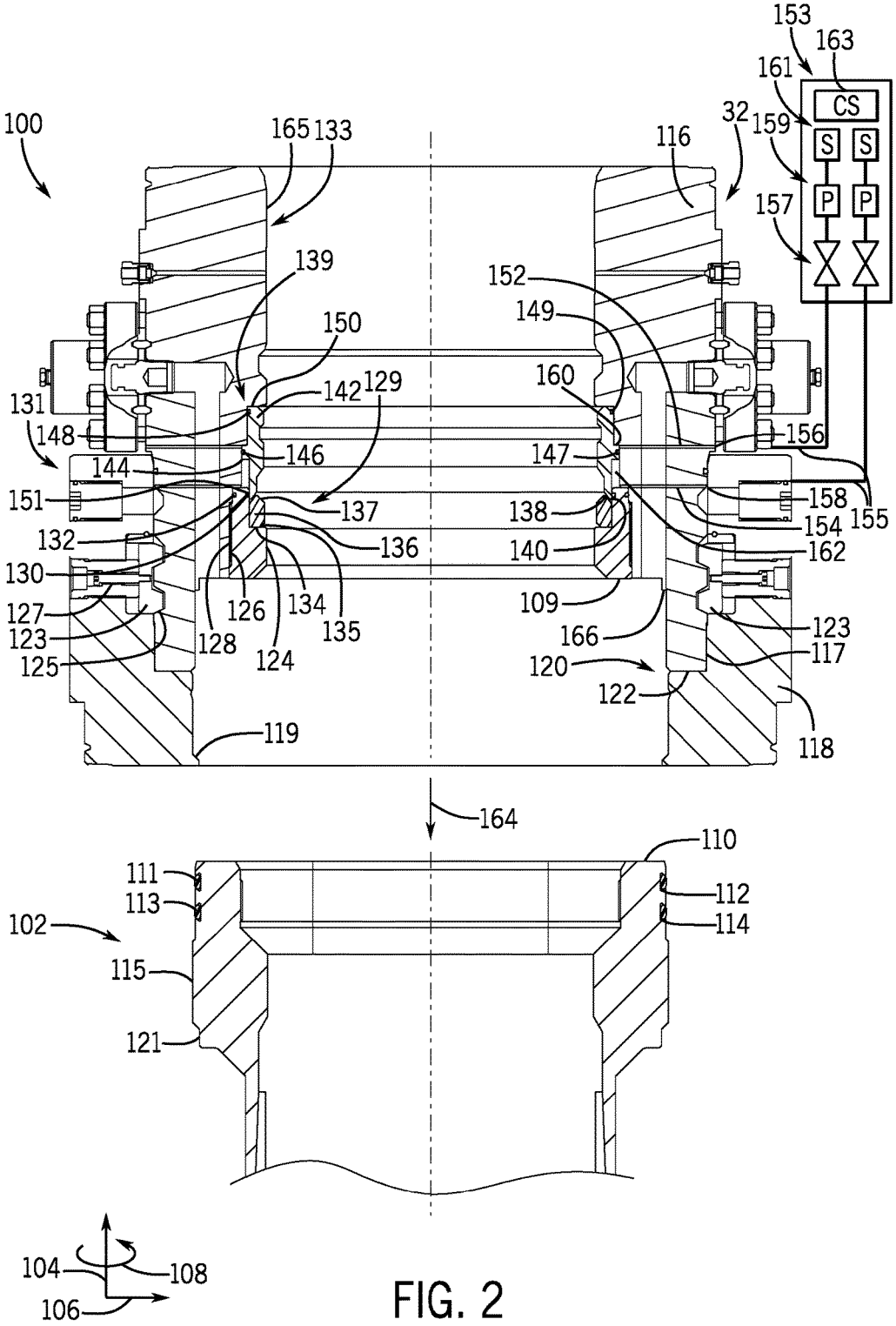
FIG. 2 is an exploded side, section view of the mineral extraction system of FIG. 1, illustrating an embodiment of a high strength load shoulder assembly exploded from a tubular prior to landing.
Figure 3:
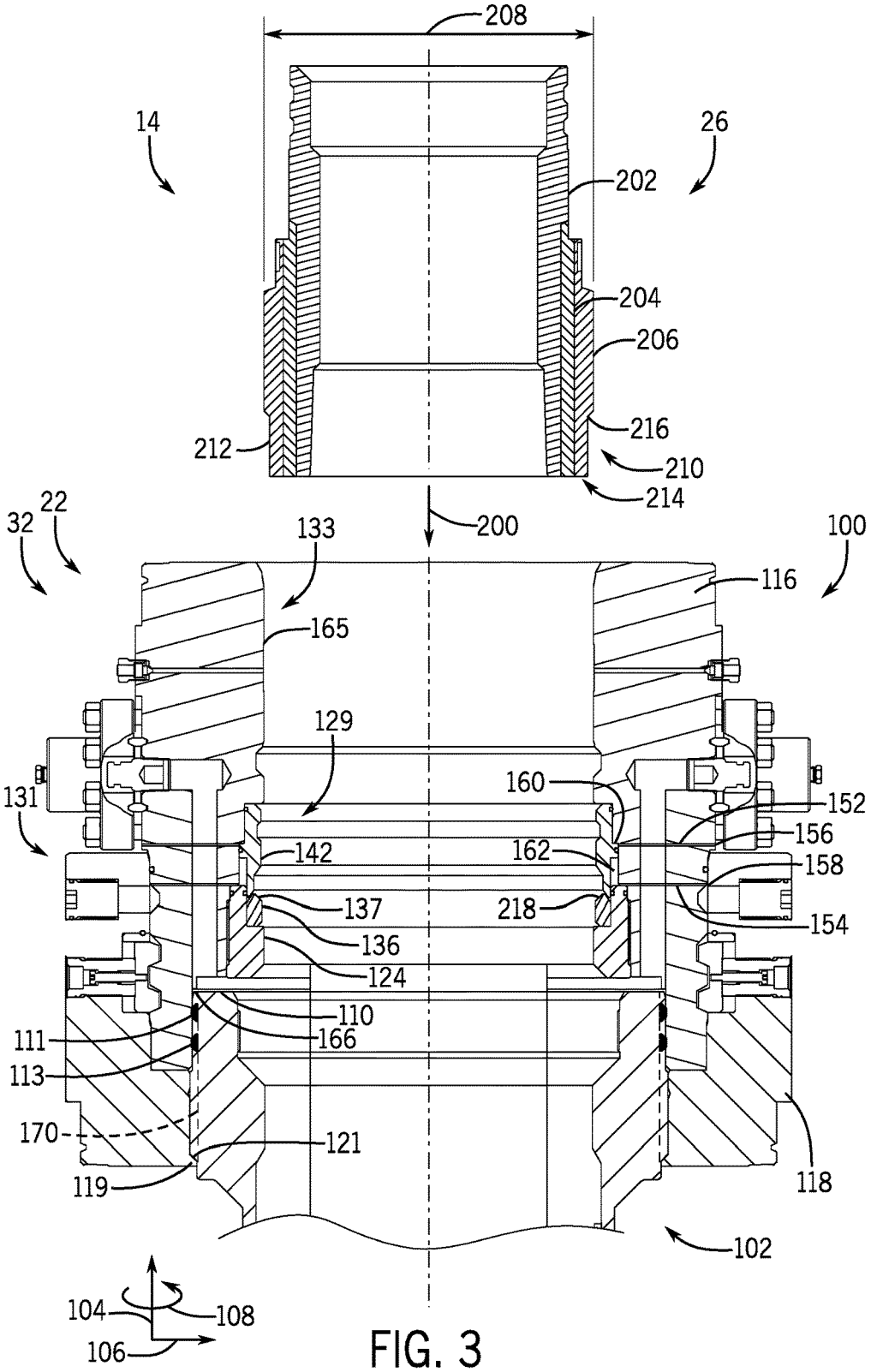
FIG. 3 is an exploded side, section view of the mineral extraction system of FIG. 1, illustrating an embodiment of a high strength load shoulder assembly landed on the tubular, and illustrating a hanger exploded from the high strength load shoulder assembly prior to landing.

FIG. 2 is a side, section view of an embodiment of a high strength load shoulder assembly 100 positioned to be installed on a tubular 102 (e.g., a casing string, tubing string, wellhead, etc.). For reference, a coordinate system is shown, including an axial direction or axis 104, a radial direction or axis 106, and a circumferential direction or axis 108. In the illustrated embodiment, the tubular 102 is generally annular in shape and includes an axial abutment surface 110 (e.g., landing surface or top surface), upon which the shoulder assembly 100 may land. The tubular 102 also includes first and second annular recesses 112, 114 supporting first and second annular seals 111, 113 (e.g., O-rings) along an outer annular surface 115. The annular seals 111, 113 disposed in the first and second recesses 112, 114 form a seal between the tubular 102 and the shoulder assembly 100, as illustrated in FIG. 3.

The high strength load shoulder assembly 100 may include an upper housing 116 (e.g., annular housing or body) and a lower housing 118 (e.g., annular housing or body) disposed about an axial end 120 of the upper housing 116. In the illustrated embodiment, the lower housing 118 includes an internal annular recess 117 having an upward facing (e.g., in the axial direction 104) annular surface 122 (e.g., axial abutment surface) that axially abuts and supports the upper housing 116. The lower housing 118 also includes at least one internal protrusion or lip 119 (e.g., annular protrusion or circumferentially spaced protrusions), which is configured to axially abut at least one corresponding external groove 121 (e.g., annular groove or circumferentially spaced slots) on the tubular 102. The lower housing 118 is removably coupled to the upper housing 116 via one or more radial locks 123, such as one or more lock rings, C-rings, locking dogs, or a combination thereof. The radial locks 123 are configured to move radially 106 inward into engagement with and radially 106 outward out of engagement with one or more locking recesses 125 (e.g., annular groove or circumferentially spaced slots) in the upper housing 116. In certain embodiments, the radial locks 123 may be disposed in the upper housing 116, and the locking recesses 125 may be disposed in the lower housing 118. The radial locks 123 may be driven by one or more actuators 127, such as energizing threaded fasteners (e.g., screws), hydraulic pistons, electric actuators, or any combination thereof. Furthermore, in some embodiments, the upper and lower housings 116 and 118 may be coupled together via one or more removable connections (e.g., mating threads along the recess 117, a plurality of threaded fasteners, split clamps, breech lock couplings, or any combination thereof) and/or fixed connections (e.g., welded joints).

As further illustrated, the high strength load shoulder assembly 100 includes an internal retractable shoulder assembly 129 within the upper housing 116, wherein the assembly 129 includes a retainer or retaining member (e.g., retainer ring 124), a load member (e.g., load bearing member, load shoulder, or load ring 136), and an energizing member (e.g., pusher, push member, or push ring 142). In certain embodiments, the load ring 136 may include a continuous annular load ring, a circumferentially segmented load ring, a split load ring (e.g., a C-ring). The retainer ring 124, the load ring 136, and the push ring 142 cooperate with one another and an actuation system or actuator 131, such that the load ring 136 selectively extends radially 106 between a retracted position or full bore position (see FIG. 5) and an extended position or active load shoulder position (see FIG. 6) as discussed in further detail below. In particular, the actuator 131 may be configured to drive the load ring 136 to contract and move radially 106 inward to the load shoulder position (see FIG. 6), which protrudes inwardly into an interior bore 133. The actuator 131 also may be configured to drive or release the load ring 136 to enable expansion radially 106 outward to the full bore position (see FIG. 5), such that the load ring 136 does no protrude into the interior bore 133. For example, upon release of the load ring 136, the load ring 136 may automatically expand due to spring force in the load ring 136. In certain embodiments, the actuator 131 may include a mechanical actuator (e.g., energizing screws), an electrical actuator (e.g., an electric motor or drive), and/or a fluid actuator (e.g., a pneumatic and/or hydraulic driven actuator). In the illustrated embodiment, the actuator 131 includes a hydraulic actuation system or hydraulic actuator with various fluid passages, pistons, seals, and the like, configured to hydraulic drive radial expansion and contraction of the load ring 136.

The retainer ring 124, load ring 136 (e.g., load shoulder), and push ring 142 of the retractable shoulder assembly 129 will now be discussed in further detail. The retainer ring 124 is disposed radially interior of, and coupled to, the upper housing 116. In the illustrated embodiment, the retainer ring 124 has a threaded exterior surface 126 that interfaces with a threaded interior surface 128 of the upper housing 116. In some embodiments, the retainer ring 124 may be coupled to the upper housing 116 by a removable coupling (e.g., threaded fasteners such as bolts, lock rings, locking dogs, clamps, or any combination thereof) and/or a fixed coupling (e.g., welded joint). During assembly, the push ring 142 may be installed into the upper housing 116, followed by installation of the load ring 136, and followed by installation of the retainer ring 124. The retainer ring 124 captures or retains the push ring 142 and the load ring 136 within an annular recess or chamber 139 within the upper housing 116. The retainer ring 124 may include an interior annular seal 130 and an exterior annular seal 132. The interior annular seal 130 may form a seal between the retainer ring 124 and the push ring 142, while the exterior annular seal 132 may form a seal between the retainer ring 124 and the upper housing 116. The retainer ring 124 may also include an annular recess or lip 134 (e.g., an annular surface that faces upward in the axial direction 104), which supports an opposing surface 135 (e.g., lower surface or bottom) of the load ring 136. In other words, the lip 134 and the surface 135 may be described as axial abutment surfaces.

The load ring 136 also includes a load shoulder surface 137 (e.g., a load bearing landing surface) disposed on an opposite side (e.g., upper surface or top) relative to the surface 135 (e.g., bottom). The load shoulder surface 137 is configured to bear a load of a component (e.g., hanger, wellhead component, valve, plug, etc.) when the load ring 136 is disposed in the active load shoulder position (see FIG. 6). The illustrated load shoulder surface 137 includes an inner tapered annular surface (e.g., conical surface); however, the surface 137 may include a flat perpendicular surface, a tapered annular surface, or a combination thereof. The load ring 136 also includes an outward tapered exterior surface 138 that interfaces with an outward tapered interior surface 140 of the annular push ring 142.

In operation, as discussed in further detail below, the push ring 142 is configured to move axially toward the load ring 136 causing engagement along the tapered surfaces 138 and 140 and subsequent axial overlap (e.g., concentric arrangement of the push ring 142 and load ring 136, which drives the load ring 136 to radially contract and extend into the active load shoulder position (see FIG. 6). Alternatively, the push ring 142 is configured to move axially away from the load ring 136 (e.g., away from the axial overlap and concentric arrangement), thereby releasing the load ring 136 and allowing radial expansion of the load ring 136 back into the annular chamber 139 to achieve the full bore position (see FIG. 5). The push ring 142 includes an annular protrusion 144 (e.g., annular piston or piston portion of ring 142), which extends outward in the radial direction 106 and includes a first exterior seal 146 (e.g., annular seal or O-ring). The first exterior seal 146 forms a first seal 147 between the push ring 142 and the upper housing 116. The push ring 142 also includes a second exterior seal 148 (e.g., annular seal or O-ring), disposed proximate an axial end 150 of the push ring 142, which forms a second seal 149 between the push ring 142 and the upper housing 116. The push ring 142 is disposed radially interior of the retainer ring 124, such that the interior seal 130 of the retainer ring 124 forms a third seal 151 between the push ring 142 and the retainer ring 124.

As discussed above, the retractable shoulder assembly 129 may be driven by the actuator 131, which may include a hydraulic actuator 131 having various fluid lines or passages 152 and 154, fluid ports 156 and 158, fluid volumes or chambers 160 and 162 (e.g., annular fluid chambers), pistons (e.g., annular pistons that include all or part of the push ring 142), etc. In the illustrated embodiment, the upper housing 116 may include first and second fluid passages 152, 154 extending in the radial direction 106 through the upper housing 116 and in fluid communication with first and second pressure ports 156, 158, respectively. The first fluid passage 152 may also be in fluid communication with a first volume 160 (e.g., first annular fluid chamber) disposed radially between the push ring 142 and the upper housing 116, and disposed axially between the first seal 147 and the second seal 149. Similarly, the second fluid passage 154 may be in fluid communication with a second volume 162 (e.g., second annular fluid chamber) disposed radially between the push ring 142 and the upper housing 116, and disposed axially between the second seal 149 and the third seal 151. As will be described in more detail below, the first and second volumes 160, 162 may be pressurized via pressurized fluid supplied through the first and second pressure ports 156, 158 (e.g., fluid ports), respectively, in order to move the push ring back and forth in the axial direction 104, which in turn expands and contracts the load ring 136 in the radial direction 106. Accordingly, the first and second pressure ports 156, 158 may be coupled to a fluid supply system 153 via one or more fluid supply lines or conduits 155, wherein the fluid supply system 153 may be part of or separate from the hydraulic actuator 131. The fluid supply system 153 may include one or more valves 157, one or more pumps 159, one or more fluid containers or supplies 161, and a controller 163 (e.g., an electronic control having a processor and memory). For example, the valves 157, pumps 159, and fluid supplies 161 may be shared between the fluid supply lines 155, or each supply line 155 may have its own dedicated valves 157, pumps 159, and fluid supplies 161. In either configuration, the controller 163 is configured to control the valves 157, pumps 159, and fluid supplies 161 to selectively provide fluid pressure to either the first pressure port 156 (and corresponding first fluid passage 152 and first volume 160) or the second pressure port 158 (and corresponding second fluid passage 154 and second volume 162). In this manner, the controller 163 is configured to control operation of the hydraulic actuator 131 and, thus, the hydraulic pressures driving movement of the retractable shoulder assembly 131.

As illustrated in FIG. 2, the retractable shoulder assembly 129 is positioned in the full bore position (see also FIG. 5), wherein the retainer ring 124, the load ring 136, and the push ring 142 do not extend beyond the annular chamber 139 into the interior bore 133 (i.e., not protruding beyond an inner circumferential surface 165 of the bore 133). As a result, the illustrated full bore position provides full bore access to the mineral extraction system. In order to install the shoulder assembly 100 on the tubular 102, the shoulder assembly 100 may be moved (e.g., via the tool 34 of FIG. 1) in the axial direction 104, as indicated by arrow 164 over and about the tubular 102 until a bottom surface 166 (e.g., annular surface) lands on the axial abutment surface 110 of the tubular 102.

FIG. 3 is a side, section view of one embodiment of the high strength load shoulder assembly 100 landed on the tubular 102 and the hanger 26 ready to be installed. As illustrated, the upper and lower housings 116 and 118 of the shoulder assembly 100 capture an enlarged portion 168 (e.g., head, flange, or mounting portion) of the tubular 102, such that the bottom surface 116 of the upper housing 116 axially abuts the top surface 110 of the tubular 102 while the internal annular protrusion 119 of the lower housing 118 axially abuts the external annular groove 121 of the tubular 102. The lower housing 118 may be installed on the tubular 102 in a variety of ways. For example, in some embodiments, the lower housing 118 may include one or more circumferential splits (e.g., one or more openings extending along the axial direction 104), thereby enabling the lower housing 118 to be expanded and fit around the enlarged portion 168, followed by contraction around the enlarged portion 168 such that the internal annular protrusion 119 and the external annular groove 121 axially abut one another. By further example, the internal annular protrusion 119 may include circumferential breaks or gaps, such that the internal annular protrusion 119 is segmented into a plurality of circumferentially spaced protrusions. In addition, the enlarged portion 168 may include a plurality of axial grooves or slots 170 between the top surface 110 and the external annular groove 121, thereby providing a passage for the protrusions 119. During installation, the lower housing 118 may be lowered in the axial direction 104, rotated to align the plurality of protrusions 119 with the corresponding plurality of slots 170, lowered further to pass the protrusions 119 through the slots 170, and then again rotated to interlock the protrusions 119 with the groove 121. However, the lower housing 118 may be coupled to the tubular 110 with any suitable coupling or mount, including threaded fasteners (e.g., screws or bolts), threaded surfaces between the lower housing 118 and the tubular 110, clamps, snap-fit connections, welds, or any combination thereof. Once secured as shown in FIG. 3, the shoulder assembly 100 may be ready to receive a component, such as the illustrated hanger 26 or various other mineral extraction components, wellhead components, valves, plugs, or any combination thereof. The component (e.g., hanger 26) may begin the installation process either before, after, or during actuation of the retractable shoulder assembly 131 from the full bore position (see FIG. 5) to the active load shoulder position (see FIG. 6). As illustrated, the push ring 142 is in an elevated position, such that the first volume 160 is substantially smaller than the second volume 162, and the load ring 136 is in a radially expanded position (e.g., retracted position within the annular chamber 139 and the annular recess or lip 135). In other words, the load ring 136 is shown in the full bore position.

As illustrated, the hanger 26 may be generally annular in shape, with one or more concentric annular layers or walls 202, 204, 206. The hanger 26 may have an outside diameter 208 sized such that the hanger 26 fits within the upper housing 116 of the shoulder assembly 100. The hanger 26 may include an annular recess 210 on an exterior surface 212, at an axial end 214 of the hanger 26. The recess 210 may be defined in part by an inward tapered exterior surface 216 (e.g., tapered landing surface), which may correspond with an inward tapered interior surface 218 of the load shoulder surface 137 of the load ring 136. The hanger 26 may be positioned within the shoulder assembly 100 by moving the hanger 26 (e.g., via the tool 34, such as a hanger running tool) in the axial direction 104 downwardly into the shoulder assembly 100, as indicated by arrow 200. The hanger 26 may be lowered into the shoulder assembly 100 until the tapered exterior surface 216 generally aligns with the tapered interior surface 218. Again, in certain embodiments, the actuator 131 may be configured to drive the load ring 136 from the full bore position (see FIG. 5) to the active load shoulder position (see FIG. 6) prior to, during, or after lowering of the hanger 26 into the shoulder assembly 100, such that the tapered surfaces 216, 218 axially abut one another as the hanger 26 is lowered into the shoulder assembly 100, thereby landing the hanger 26 in the shoulder assembly 100.

Figure 4:
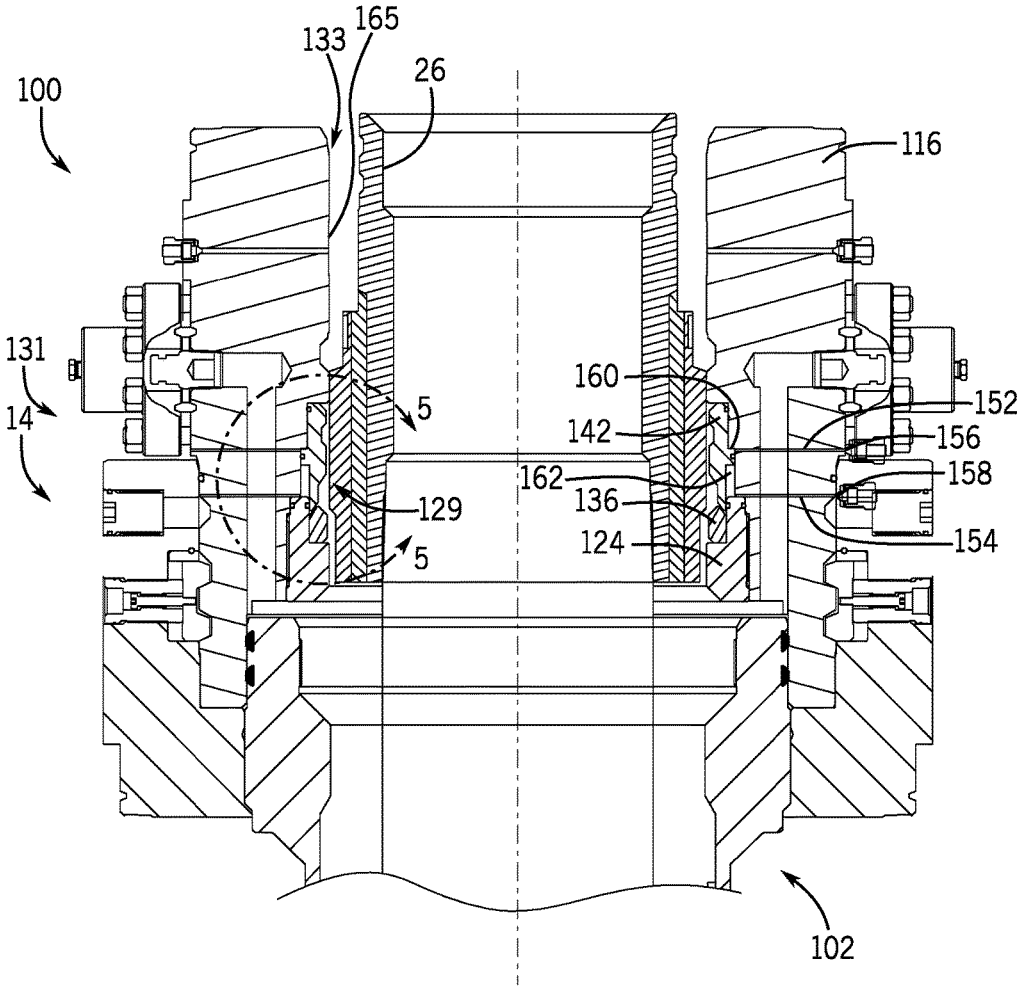
FIG. 4 is a side, section view of the mineral extraction system of FIG. 1, illustrating the hanger positioned within the high strength shoulder assembly.
Figure 4:
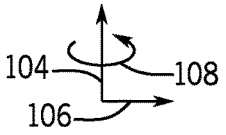

FIG. 4 is a side, section view of an embodiment of the hanger 26 positioned within the shoulder assembly 100 prior to actuation of the load ring 136 by the push ring 142. The actuator 131 may be configured to drive the push ring 136 axially against the load ring 136, thereby driving the load ring 136 to move radially from the illustrated full bore position (see also FIG. 5) to the active load shoulder position (see FIG. 6) prior to, during, or after lowering of the hanger 26 into the shoulder assembly 100. In other words, for purposes of illustration, the hanger 26 is disposed within the shoulder assembly 100 with the tapered surfaces 216, 218 generally aligned with one another, but the load ring 136 is not yet actuated to capture the hanger 26. In operation, to move from the illustrated full bore position (see also FIG. 5) to the active load shoulder position (see FIG. 6), the fluid supply system 153 of the actuator 131 may be configured to supply fluid (e.g., liquid or gas) through the first passage 152 via the first pressure port 156, thereby supplying the fluid to the first volume 160 between the upper housing 116 and the push ring 142. As the first volume 160 becomes pressurized by the supplied fluid (e.g., hydraulically or pneumatically pressurized), the supplied fluid drives or pushes the push ring 142 downward in the axial direction 104 toward the load ring 136, thereby radially contracting the load ring 136 and capturing the hanger 26. Alternatively, to move from active load shoulder position (see FIG. 6) to the full bore position (see FIG. 5), the fluid supply system 153 of the actuator 131 may be configured to supply fluid (e.g., liquid or gas) through the second passage 154 via the second pressure port 158, thereby supplying the fluid to the second volume 162 between the upper housing 116 and the push ring 142. As the second volume 162 becomes pressurized by the supplied fluid (e.g., hydraulically or pneumatically pressurized), the supplied fluid drives or pushes the push ring 142 upwardly in the axial direction 104 away from the load ring 136, thereby releasing and enabling expansion of the load ring 136 and releasing the hanger 26. This is shown and described in more detail with regard to FIGS. 5 and 6.

Figure 5:
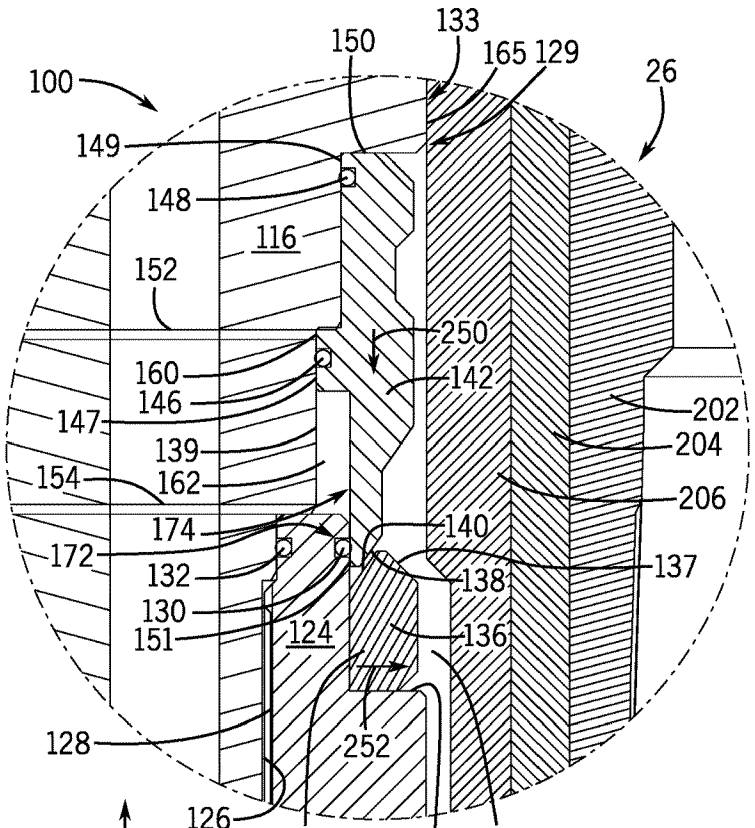
FIG. 5 is a side, section view of the mineral extraction system of FIG. 3, taken within line 5-5, illustrating an internal retractable shoulder assembly in a full bore position with a load ring in a retracted position.

FIG. 5 is a side, section, detail view of the mineral extraction system of FIG. 3, taken within line 5-5, illustrating the internal retractable shoulder assembly 129 in a full bore position with the load ring 136 in a retracted position within the annular chamber 139 (e.g., not protruding into the bore 133 beyond the surface 165). FIG. 6 is a side, section, detail view of the mineral extraction system of FIG. 3, taken within line 5-5, illustrating the internal retractable shoulder assembly 129 in an active load shoulder position with the load ring 136 in an extended position beyond the annular chamber 139 (e.g., protruding into the bore 133 beyond the surface 165). In operation, the hydraulic actuator 131 and the fluid supply system 153 shown in FIG. 2 may be used to selectively apply pressurized fluid (e.g., liquid or gas) to one of the fluid passages 152, 154 to drive the push ring 142 in an axial upward or downward direction 104, thereby driving contraction or enabling expansion of the load ring 136 in the radial direction 106.

Figure 6:
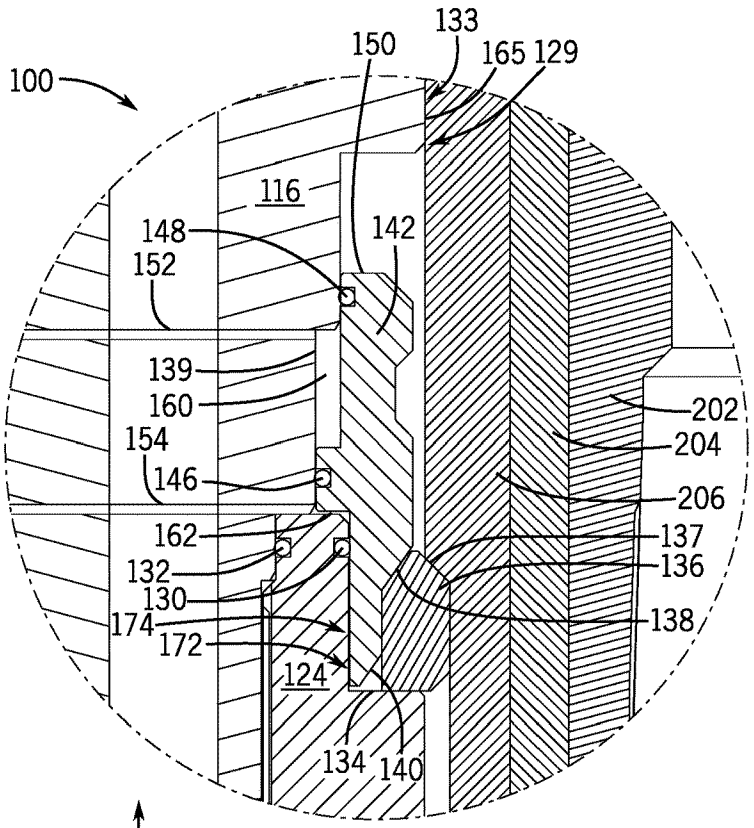
FIG. 6 is a side, section view of the mineral extraction system of FIG. 3, taken within line 5-5, illustrating the internal retractable shoulder assembly in an active load shoulder position with the load ring in an extended position.

For example, the hydraulic actuator 131 and the fluid supply system 153 may selectively supply pressurized fluid (e.g., hydraulic fluid) to the first pressure port 156 (see FIG. 2) and the corresponding first fluid passage 152 to move the load ring 136 from the full bore position (see FIG. 5) to the active load shoulder position (see FIG. 6.). In particular, the fluid pressure passes through the first fluid passage 152, fills and pressurizes the first volume 160, and consequently drives or pushes the push ring 142 axially downward as indicated by the arrow 250 in FIG. 5, expanding the first volume 160 and shrinking the second volume 162. As the push ring 142 moves axially downward, the outward tapered interior surface 140 of the push ring 142 (e.g., an energizing ring portion 172) interfaces with the outward tapered exterior surface 138 of the load ring 136, such that the load ring 136 radially contracts as indicated by arrow 252 in FIG. 5, into a volume 254 disposed radially between the load ring 136 and the hanger 26. In other words, the push ring 142 drives the load ring 136 to move radially inward beyond the inner circumferential surface 165 of the bore 133, such that the push ring 142 radially protrudes into the bore 133 to enable landing of the hanger 26. As the push ring 142 continues to move axially downward, the push ring 142 progressively overlaps the load ring 136 in the axial direction 104, such that the push ring 142 and the load ring 136 are disposed in a concentric relationship (e.g., a holding ring portion 174 of the push ring 142 surrounds the load ring 136) as illustrated in FIG. 6. The holding ring portion 174 of the push ring 142 is configured to block radial movement of the load ring 136 (e.g., retraction into the annular chamber 139), thereby maintaining the load ring 136 in the active load shoulder position of FIG. 6. As further illustrated in FIG. 6, the push ring 142 is in a lowered position, resting on the lip 134 of the retainer ring 124. Furthermore, the load ring 136 is radially contracted and in contact with the hanger 26, such that the load shoulder surface 137 abuts the tapered landing surface 216 of the hanger 26.

It should be understood that high strength load shoulder assembly 100 may release the hanger 26 in a similar, but opposite fashion as it captures the hanger 26. For example, the hydraulic actuator 131 and the fluid supply system 153 may selectively supply pressurized fluid (e.g., hydraulic fluid) to the second pressure port 158 (see FIG. 2) and the corresponding second fluid passage 154 to move the load ring 136 from the active load shoulder position (see FIG. 6.) to the full bore position (see FIG. 5). In particular, the fluid pressure passes through the second fluid passage 154, fills and pressurizes the second volume 162, and consequently drives or pushes the push ring 142 axially upward from the position of FIG. 6 to the position of FIG. 5, expanding the second volume 162 and shrinking the first volume 160. As the push ring 142 moves axially upward, the push ring 142 progressively reduces and eliminates the axial overlap and concentric arrangement between the push ring 142 and the load ring 136, and eventually releases the load ring 136 to enable automatic retraction back into the annular chamber 139 (e.g., radial expansion from the position of FIG. 6 to the position of FIG. 5). As further illustrated in FIG. 5, the push ring 142 is in a raised position, axially above the load ring 136. Furthermore, the load ring 136 is radially expanded and no longer in contact with the hanger 26, such that the load shoulder surface 137 does not abut the tapered landing surface 216 of the hanger 26.

Figure 7:
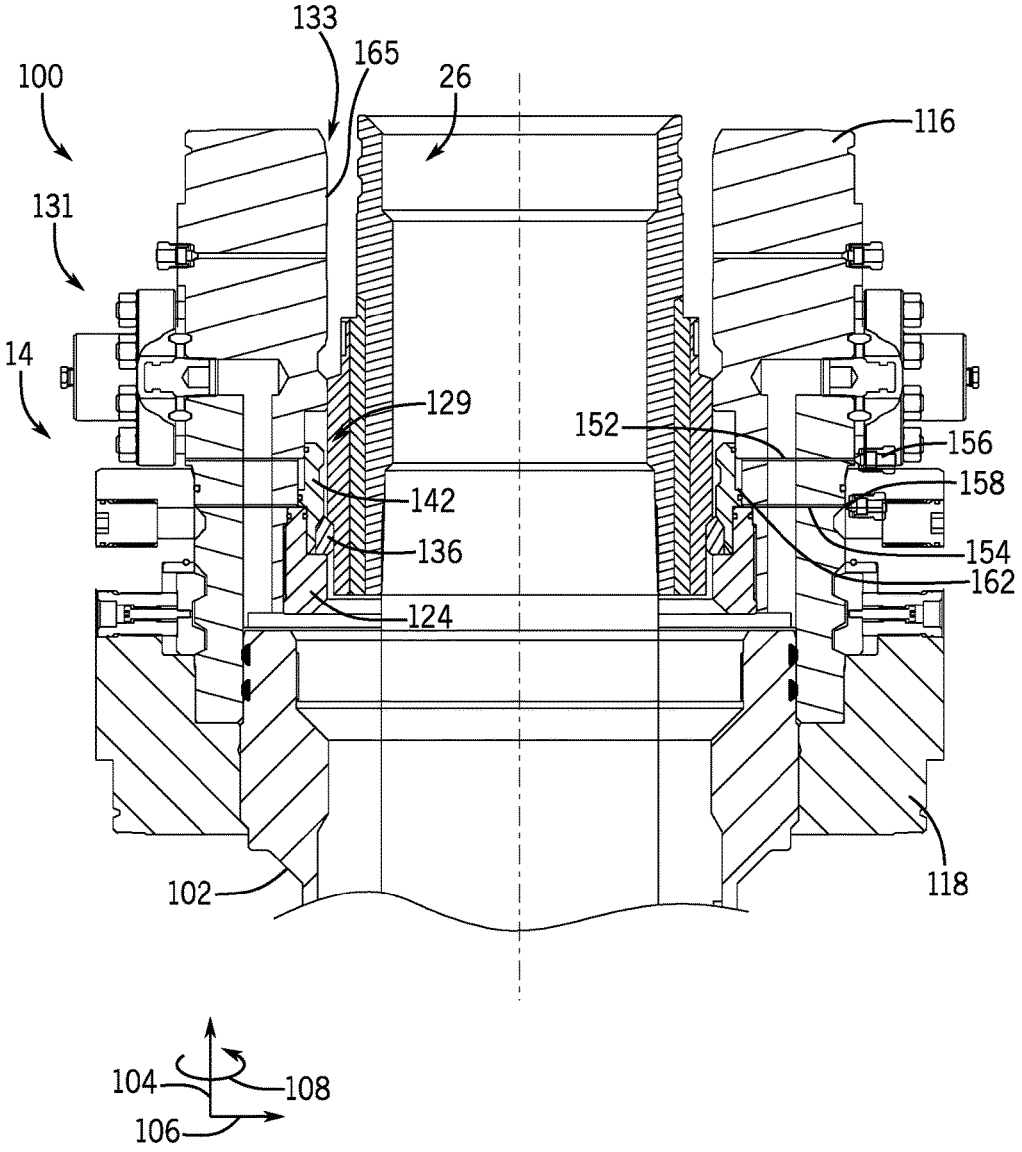
FIG. 7 is a side, section view of the mineral extraction system of FIGS. 3 and 6, illustrating the hanger landed on the high strength shoulder assembly after actuation of the load ring by the push ring.

FIG. 7 is a side, section view of the high strength load shoulder assembly 100 disposed on the tubular 102 with the hanger 26 installed. As illustrated, the push ring 142 is in a lowered position, resting on the retainer ring 124, pushing and holding the load ring 136 radially inward against the hanger 26. At this point, additional components may be run into the wellhead assembly 14 and supported via the hanger 26.

The disclosed embodiments enable a high strength load shoulder assembly 100 to selectively change positions of an internal retractable shoulder assembly 129 between a full bore position (see FIG. 5) and an active load shoulder position (see FIG. 6). In this manner, the load shoulder assembly 100 can provide full bore access for various tools and procedures, while also providing a load shoulder (e.g., load shoulder surface 137 of load ring 136) when desired for landing various wellhead components, mineral extraction components, valves, plugs, and hangers (e.g., hanger 26). The disclosed embodiments also may enable one trip installation and landing of the load shoulder assembly 100 and the hanger 26, thereby reducing time and costs associated with landing the hanger 26 in an otherwise full bore system.

While the disclosed subject matter may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The invention claimed is:

1. A system, comprising:

a load shoulder assembly configured to land a component in a bore of a mineral extraction system, wherein the load shoulder assembly comprises:

a housing;

a retractable shoulder assembly comprising a load ring having a load shoulder surface, wherein the retractable shoulder assembly is disposed in the housing, wherein the retractable shoulder assembly is configured to retract the load shoulder surface to a retracted position, providing full bore access, by moving the load ring radially outward with respect to the bore and to extend the load shoulder surface to an extended position by moving the load ring radially inward relative to the bore, wherein when the load shoulder surface is in the extended position, the load shoulder surface is configured to support the component that lands on the load shoulder surface;

a push ring disposed radially interior of the housing and configured to move in an axial direction between a raised position and a lowered position to drive radial movement of the load ring between the retracted position and the extended position; and a first fluid chamber and a second fluid chamber each disposed radially between the push ring and the housing, wherein the first fluid chamber is configured to expand to drive the push ring to the lowered position, driving the load shoulder surface into the extended position, and the second fluid chamber is configured to expand to drive the push ring to the raised position, retracting the load shoulder surface into the retracted position.

2. The system of claim 1, wherein the housing comprises an upper housing coupled to a lower housing.

3. The system of claim 2, wherein the upper and lower housings are coupled together by one or more radial locks.

4. The system of claim 1, wherein the housing is configured to land on a tubular of the mineral extraction system.

5. The system of claim 1, wherein the housing comprises an annular chamber recessed relative to the bore, and the retractable shoulder assembly is disposed in the annular chamber.

6. The system of claim 1, wherein the push ring is configured to move in response to hydraulic pressure from a fluid supply system.

7. The system of claim 1, wherein the retractable shoulder assembly comprises a retainer ring, and the load ring is disposed between the push ring and the retainer ring.

8. The system of claim 7, wherein the push ring, the load ring, and the retainer ring are disposed in an annular recess in the housing.

9. The system of claim 8, wherein a first fluid passage extends through the housing to the first fluid chamber, and a second fluid passage extends through the housing to the second fluid chamber.

10. The system of claim 9, wherein a piston portion of the push ring is disposed between the first and second fluid chambers.

11. The system of claim 10, comprising a fluid supply system coupled to a hydraulic actuator having the first and second fluid passages extending to the respective first and second fluid chambers.

12. The system of claim 1, comprising the component, wherein the component comprises a mineral extraction component, a wellhead component, a valve, a plug, or a combination thereof.

13. The system of claim 1, comprising the component, wherein the component comprises a hanger.

14. A method for landing a component in a bore of a mineral extraction system, comprising:

extending a load shoulder surface of a retractable shoulder assembly, with respect to the bore, to an extended position by moving the load shoulder surface radially inward relative to a bore in a housing of the retractable shoulder assembly, wherein a push ring, disposed radially interior of the housing, moves in a first axial direction to a lowered position to drive radial movement of a load ring in response to increasing pressure to a first fluid chamber disposed radially between the push ring and the housing, and wherein the load shoulder surface is configured to support a component that lands on the load shoulder surface, when the load shoulder surface is disposed in the extended position; and retracting the load shoulder surface with respect to the retractable shoulder assembly, to provide full bore access, by moving the load shoulder surface radially outward with respect to the bore, wherein the push ring moves in a second axial direction to a raised position to drive radial movement of the load ring in response to increasing pressure to a second fluid chamber disposed radially between the push ring and the housing.

15. The method of claim 14, wherein selectively extending the load shoulder surface from a retracted position to the extended position enables landing of the component in the mineral extraction system.

16. The method of claim 14, wherein selectively retracting and extending the load shoulder surface comprises controlling a hydraulic actuator to drive movement of the load shoulder surface.

17. A system, comprising:

a component of a mineral extraction system;

a tubular of the mineral extraction system; and a load shoulder assembly configured to land the component in a bore of the mineral extraction system, wherein the load shoulder assembly comprises:

a housing configured to couple to the tubular;

a retractable shoulder assembly comprising a load ring having a load shoulder surface, wherein the retractable shoulder assembly is disposed in the housing, wherein the retractable shoulder assembly is configured to selectively retract the load shoulder surface, to a retracted position, providing full bore access, by moving the load ring radially outward with respect to the bore and to extend the load shoulder surface to an extended position by moving the load ring radially inward relative to the bore, wherein when the load shoulder surface is in the extended position, the load shoulder surface is configured to support the component that lands on the load shoulder surface;

a push ring disposed radially interior of the housing and configured to move in an axial direction between a raised position and a lowered position to drive radial movement of the load ring between a retracted position and an extended position; and a first fluid chamber and a second fluid chamber each disposed radially between the push ring and the housing, wherein the first fluid chamber is configured to expand to drive the push ring to the lowered position, driving the load shoulder surface into the extended position, and the second fluid chamber is configured to expand to drive the push ring to the raised position, retracting the load shoulder surface into the retracted position.

* * * * *